US005279054A

United States Patent [19]

Chasen

[11] Patent Number: 5,279,054

[45] Date of Patent: Jan. 18, 1994

[54] STEAM IRON INCLUDING DOUBLE BOILER PORTIONS, HEATERS, AND THERMOSTAT

[75] Inventor: James E. Chasen, West Haven, Conn.

[73] Assignee: Black & Decker Inc., Newark, Del.

[21] Appl. No.: 796,511

[22] Filed: Nov. 21, 1991

[51] Int. Cl.[5] ..... D06F 75/18; D06F 75/24; H05B 3/00

[52] U.S. Cl. ..... 38/77.7; 38/77.83; 219/254

[58] Field of Search ..... 38/74, 77.1, 77.5, 77.7, 38/77.8, 77.82, 77.9, 88, 77.83; 219/254, 255

[56] References Cited

U.S. PATENT DOCUMENTS

| | | | |
|---|---|---|---|
| 2,078,061 | 4/1937 | Cooper | 38/77.82 |
| 2,437,571 | 3/1948 | Waage | 38/77.82 |
| 2,837,847 | 6/1958 | Franklin et al. | 38/77.82 |
| 2,861,365 | 11/1958 | Block | 38/77.82 |
| 3,263,350 | 8/1966 | Abraham | 38/77.7 |
| 4,077,143 | 3/1978 | Walker et al. | 38/77.83 |
| 4,656,763 | 4/1987 | Kawasaki et al. | 38/77.7 X |
| 4,939,342 | 7/1990 | Frens et al. | 38/77.7 X |
| 5,074,066 | 12/1991 | Sakano et al. | 38/77.8 |
| 5,115,117 | 5/1992 | Amidt et al. | 38/77.83 X |

FOREIGN PATENT DOCUMENTS

| | | | |
|---|---|---|---|
| 0905833 | 7/1972 | Canada | 38/77.83 |
| 0541061 | 10/1959 | France | 38/77.82 |

*Primary Examiner*—Clifford D. Crowder
*Assistant Examiner*—Ismael Izaguirre
*Attorney, Agent, or Firm*—Barry E. Deutsch

[57] ABSTRACT

An electric steam iron includes a housing, a water reservoir, a boiler in fluid flow communication with said water reservoir, a soleplate, a first heater for the boiler, and a second heater for the soleplate. A fluid control device regulates the flow of fluid from the reservoir to the boiler. A first thermostat independently regulates the operation of the boiler heater and a second thermostat independently regulates the operation of the soleplate heater. The first and second thermostats are electrically separated from each other and thus the first and second heaters are independently controlled. The boiler comprises a first member in direct contact with the first heater for receiving water from the reservoir and transforming the water into steam. A second member overlies the first member and defines therebetween a first flow path for the steam. A third member overlies the second member and defines therebetween a second flow path for the steam. The first and second flow paths are in fluid flow communication such that the steam flowing in the second flow path flows in a direction opposite to the steam flowing in the first flow path. The steam flowing through the second flow path is supplied to the soleplate for distribution onto a garment.

12 Claims, 3 Drawing Sheets

STEAM IRON INCLUDING DOUBLE BOILER PORTIONS, HEATERS, AND THERMOSTAT

BACKGROUND OF THE INVENTION

1. Field of the Invention

This invention relates to an electric steam iron and in particular, to the boiler thereof used for generating steam.

2. Background Information

Generally, most electric steam irons in use today employ a "flash" steam system wherein water contained in a water reservoir is dropped directly on a hot soleplate to generate steam. The generated steam temperature is usually superheated and is directly proportional to the soleplate temperature. It has been found that relatively high temperature superheated steam is not as effective for ironing garments as steam at or near saturated conditions (100° C.). It has been also determined that saturated steam with some moisture content can relax the fabric of the garment being ironed and result in a more satisfactorily ironed garment.

To generate lower steam temperature in conventional irons the soleplate temperature must be reduced which sometimes results in water spotting and inadequate heat for the fabric being ironed.

To overcome the disadvantages of a "flash" steam system, irons having separate boilers for generating steam and which are heated and controlled independently of the soleplate have been designed. Examples of such prior art illustrating separate soleplate and boiler heaters are found in U.S. Pat. Nos. 2,387,757, 2,499,835, and 3,263,350. The addition of a second heater dedicated to the generation of steam has typically increased the elevational profile of the iron, making the iron more expensive to manufacture, and less aesthetically attractive.

Further, it has been found that when operating an electric iron at or near saturation conditions, the generated steam must be directed through a relatively tortuous path to separate relatively large droplets of condensation from the steam. If relatively large droplets or slugs of water are not separated from the steam and are discharged from the iron, these droplets tend to cause water spotting of the fabric being ironed.

It is, therefore, an object of this invention to manufacture an electric steam iron that has a first heater for generating steam and a second heater for heating the soleplate of the iron. It is a further object to produce steam at or near its saturation temperature. It is still a further object of the invention to generate steam at or near its saturation temperature and to effectively remove relatively large droplets of water entrained in the steam before the steam is discharged onto fabric.

SUMMARY OF THE INVENTION

These and other objects of the invention are attained in an electric steam iron having a housing; a water reservoir mounted in the housing; the housing further defining a boiler in fluid flow communication with said water reservoir; a soleplate; a heater for said boiler; a heater for said soleplate; fluid control means for regulating the flow of fluid from said water reservoir to said boiler; first and second thermostatic means for respectively independently regulating the operating temperature of said boiler and said soleplate heaters; said boiler comprising a first member in direct contact with said boiler heater for receiving water from said reservoir and transforming said water into steam, a second member overlying said first member and defining therebetween a first flow path for said steam, and a third member overlying said second member and defining therebetween a second flow path for said steam, said first and second flow paths being in fluid flow communication such that the steam flowing through said second flow path flows in a direction opposite to the steam flowing in said first flow path; and means for distributing the steam flowing from said second flow path through said soleplate.

DESCRIPTION OF THE PREFERRED EMBODIMENT

Referring now to the various figures of the drawings, a preferred embodiment of the invention shall now be described in detail. In referring to the various figures, like numerals shall refer to like parts.

Figure 1:
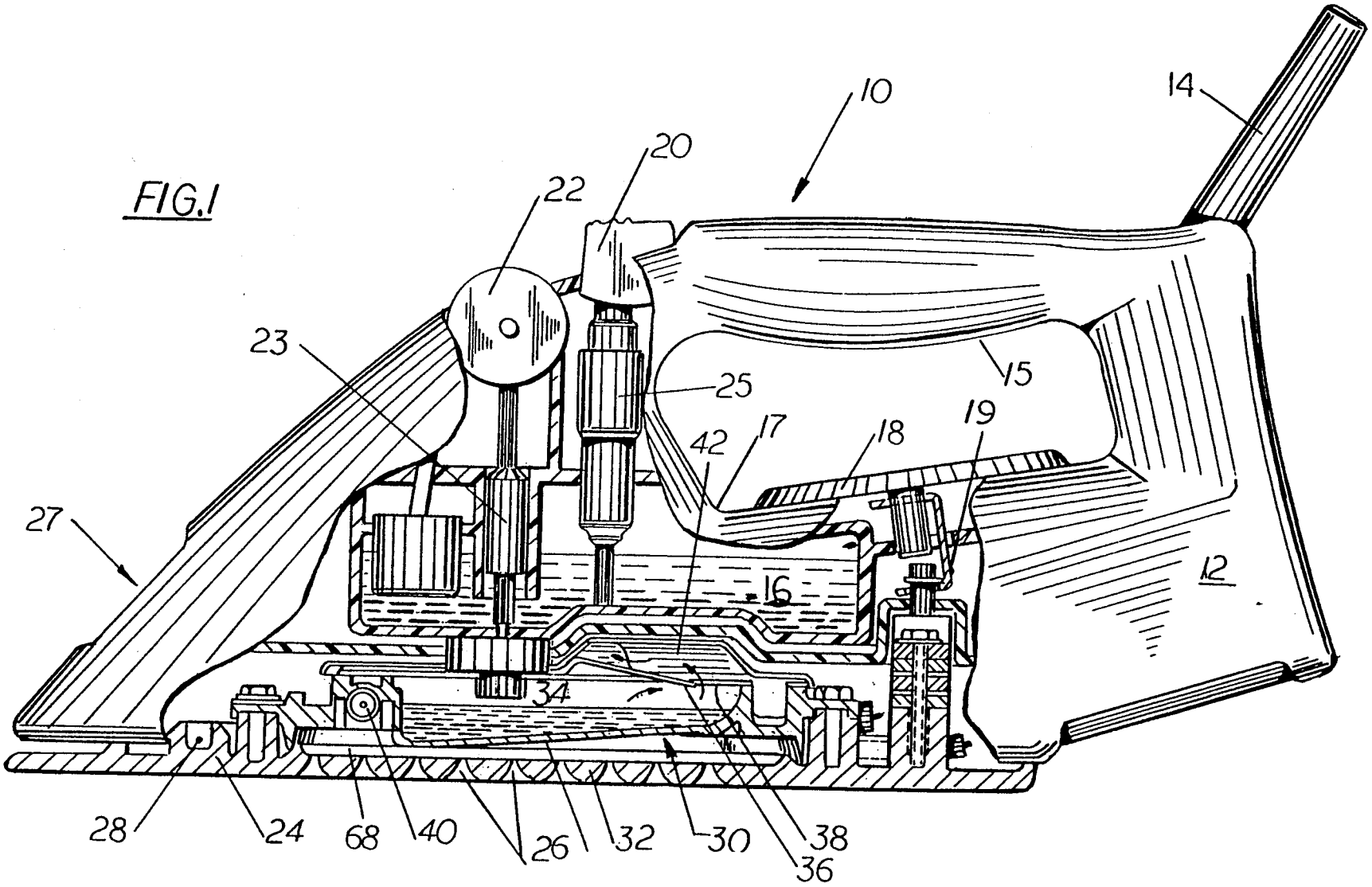
FIG. 1 is an elevational view, partially in section, of an electric iron embodying the present invention.
Figure 2:
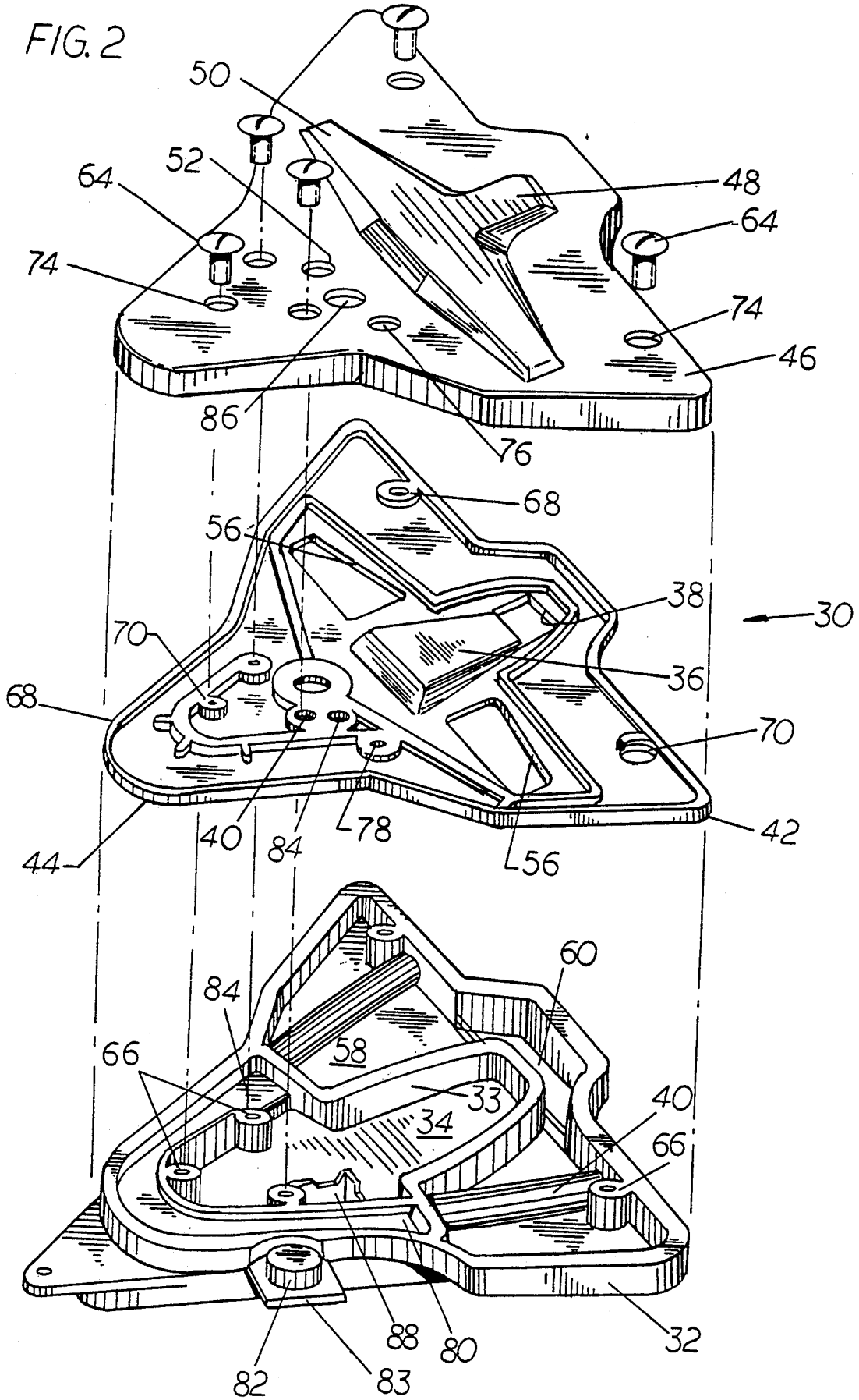
FIG. 2 is an exploded perspective view illustrating key features of the invention.
Figure 3:
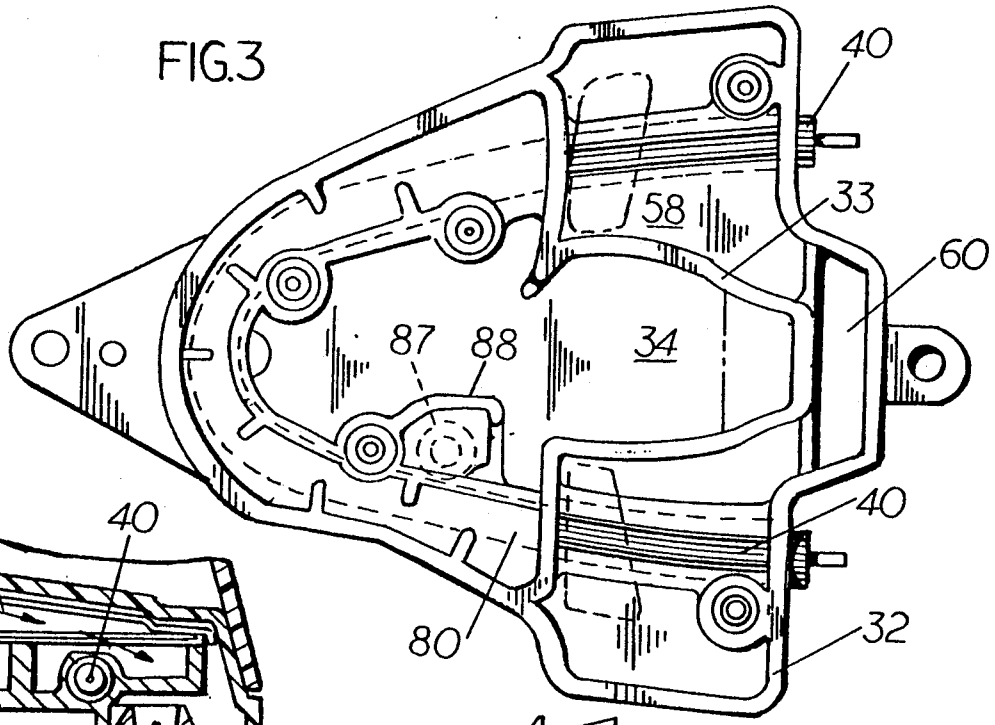
FIG. 3 is a plan view of one of the members forming the present invention.
Figure 4:
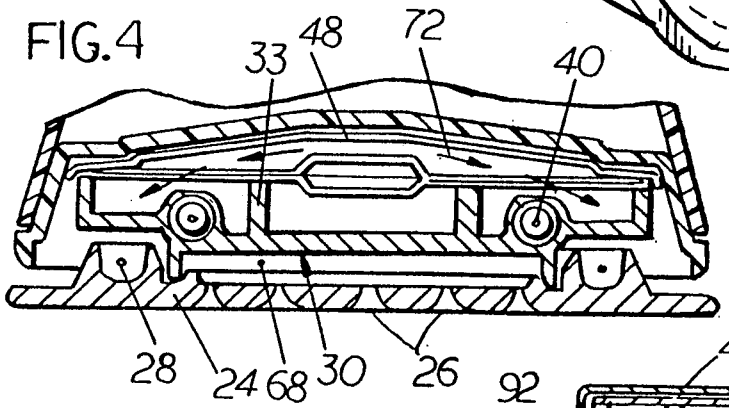
FIG. 4 is a sectional view taken along line 4—4 of FIG. 5.

Referring specifically to FIG. 1, electric iron 10 includes a housing 12 formed from suitable material such as polypropylene. An electric cord 14 extends from the rear of housing 12 and connects iron 10 to a source of electrical power. A water reservoir 16 is mounted or contained in housing 12. Housing 12 includes a handle 15 and a saddle portion 17. A control knob 18 is mounted on saddle portion 17 for regulating the operation of thermostat 19. Thermostat 19 controls the operating temperature of a first heater 28. Heater 28 is operatively connected to soleplate 24. The temperature of the soleplate may be varied by the user of iron 10 through appropriate movement of control knob 18.

A first control knob 22 is mounted at the top forward portion of housing 12 and functions to regulate the operation of fluid flow control means 23. Fluid flow control means 23 meters the flow of fluid from water reservoir 16 into a boiler 30 for a reason that shall be more fully described hereinafter.

A second control knob 20 is also mounted at the top of housing 12. Control knob 20 operates a pump 25 which is used to inject a relatively large quantity of water into boiler 30. The water is injected when a surge of steam is desired by the user. Pump 25 is also connected to a spray nozzle located at the nose 27 of housing 12.

As noted previously, thermostat 19 can be regulated by the user of the iron to vary the temperature of heater 28 and thus the operating temperature of soleplate 24. Some fabrics, such as cotton, must be ironed at a relatively high temperature to obtain an acceptably ironed garment. Other fabrics such as rayon, silk, and the like are delicate and can only be ironed at relatively low temperatures. In fact, these rather delicate fabrics may be ironed at temperatures at or even below the vaporization temperature of water and thus steam cannot be generated when these fabrics are being conventionally ironed. Likewise, when the relatively high temperature fabrics are being ironed, the temperature of the soleplate is significantly above the vaporization temperature of water and thus when the user requires steam from the iron, the generated steam has a significant amount of superheat and does not provide an ironed garment that is as acceptable to the user as is a garment ironed with steam at or near saturated conditions.

Iron 10 includes separate boiler 30, details of which are specifically shown in FIGS. 2-5. Unlike a conventional iron, boiler 30 has a separate heater 40 which is designed to generate steam at or near saturation temperature. Boiler 30 is mounted in housing 12 and includes a first member 32 having a generally centrally located axially extending portion or passage 34 defined by a vertically upwardly extending generally U-shaped rib 33. Water under control of fluid control means 23 is metered from reservoir 16 into the forward section of portion 34 of first member 32. Bottom wall or floor 35 of member 32 is canted or sloped in a forward direction approximately 5 degrees relative to a horizontal line. A generally U-shaped heater 40 provides sufficient heat to transform the water into steam. Member 32 includes a generally flat ledge-like surface 83 for mounting a single set-point thermostat 82. As used herein the term "single set-point thermostat" means a thermostat designed to operate at a single control temperature. Thermostat 82 regulates the operation of heater 40. Thermostat 82 is electrically separated from thermostat 19. Thus the operation of the thermostats are independent of each other and heaters 28 and 40 are independently controlled.

Boiler 30 includes a second member 44 which overlies first member 32. Member 44 in combination with first member 32 defines a first flow path for the steam generated in passage 34. Member 44 includes an opening 38 which is aligned with the rear portion of passage 34. An inclined baffle 36 extends upwardly from opening 38 and is axially aligned therewith. Member 44 also includes a fluid flow opening 54 and a pair of fluid flow slots 56. The purposes of flow opening 54 and slots 56 shall be more fully explained hereinafter.

Figure 5:
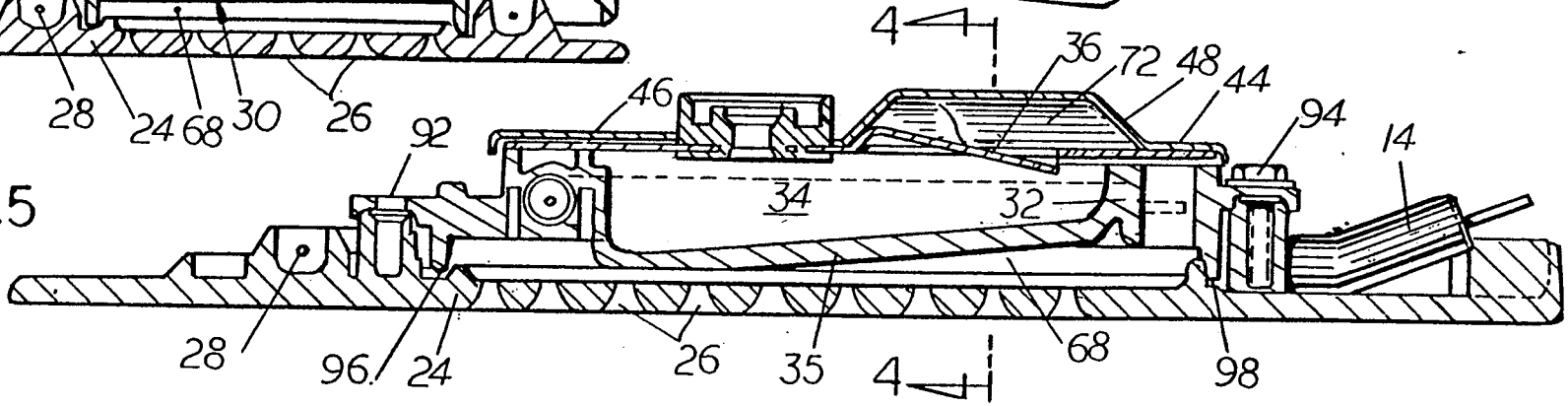
FIG. 5 is an enlarged longitudinal sectional view of a portion of the iron illustrated in FIG. 1.

As illustrated particularly in FIG. 5, member 46 includes an inverted cuplike element 48 in general vertical alignment with inclined baffle 36 and defining therebetween a second steam flow passage 72. As illustrated by the arrows drawn in FIG. 1, the steam flow through first passage 34 is in a direction opposite to the steam flow through second passage 72. It should also be noted that inclined baffle 36 directs the steam upwardly as the steam leaves first flow passage 34 and enters second flow passage 72.

Element 48 includes a pair of laterally extending wings 50 which define lateral extensions for the flow of steam in second flow passage 72. Lateral extensions 50 are in vertical alignment with slots 56 provided in second member 44. Slots 56 in turn are in alignment with generally U-shaped channel 58 in member 32. Member 46 also includes flow opening 52 vertically aligned with opening 54 of member 44. Fluid flow control means 23 regulates the flow of fluid from reservoir 16 through flow openings 52 and 54 into passage 34 of boiler 30.

Member 46 includes a further flow opening 76 in vertical alignment with flow opening 78 in member 44. Opening 76 communicates with reservoir 16 under control of pump 23. When a surge of steam is desired pump 25 is activated and water is injected from reservoir 16, through aligned openings 76 and 78 into a channel 80 formed about the top surface of heater 40. The water is directly heated by heater 40 and is transformed into steam to satisfy the user's requirements for a surge of steam. The steam flowing in channel 80 exits therefrom to mix with the steam formed in passage 34.

Member 32 includes a generally U-shaped rib 88 defining a chamber. Members 44 and 46 include openings 84 and 86 respectively. A tube 87 (shown in phantom in FIG. 3) runs from the chamber in member 32 to the air space formed in the top of reservoir 16. Rib 88 prevents water from entering into the bottom of the tube. The tube equalizes the pressure between boiler 30 and reservoir 16.

Steam flowing through second passage 72 flows outwardly in each direction via laterally extending wings 50 and thence passes downwardly through openings 56 into channel 58. The steam exits channel 58 via slot 60 which communicates with soleplate 24. The steam is distributed from the soleplate via a plurality of orifices 26 which are formed in the lower surface of the soleplate. Orifices 26 communicate with steam exit chamber 68 formed between the lower surface of member 32 and the top surface of soleplate 24.

Suitable steam seals 42 between confronting surfaces of members 32, 44 and 46 may be obtained via liquid injection molding or sheet stampings. The members forming boiler 30 are joined together via fastening means 64 such as screws, rivets or staking to upstanding posts which extend through vertically aligned openings 74, 70 and 66 formed respectively in members 46, 44 and 32.

As illustrated particularly in FIG. 5, the bottom surface of member 32 and the top surface of soleplate 24 define chamber 68. Suitable sealing material such as a liquid injection moldable gasket is placed at interfaces 96 and 98 to prevent loss of steam from chamber 68 and to prevent significant heat transfer from soleplate 24 to member 32. To further minimize heat conduction from soleplate 24 to boiler 30, the boiler is only connected to and supported by the soleplate at two points namely via screw 94 and 92.

In normal operation, the user of iron 10 regulates the supply of wattage to heater 28 to obtain a desired soleplate temperature in accordance with the specific temperature requirements of the fabric being ironed. When the user desires steam, control knob 22 is actuated to cause fluid control means 23 to supply water from requirements of the fabric being ironed. When the user desires steam, control knob 22 is actuated to cause fluid control means 23 to supply water from reservoir 16 to first flow passage 34 formed in member 32 of boiler 30. The water from the water reservoir 1 flows through opening 52 formed in plate 46 and opening 54 formed in member 44, into passage 34. As noted, floor 35 is sloped forwardly approximately 5 degrees. This slope functions to prevent water from migrating towards opening 38 and percolating therethrough into second flow passage 72.

The wattage supplied to dedicated heater 40 of boiler 30 is designed to convert the water to steam at or near saturation conditions. The steam thus formed therefore has some water vapor entrained in the gaseous molecules, which water vapor it has been determined relaxes the fabric of the garment being ironed to improve the quality of the finished ironed garment.

The steam flowing through passage 34 exits through opening 38 and is directed by inclined baffle member 36 upwardly into second flow passage 72. Although it is desirable that the steam contain a certain quantity of water vapor, it is not desirable that the steam contain large droplets or slugs of water. It has been found that large from the steam vapor. Further, the inclination of baffle 36 results in the steam flow being directed vertically upwardly. Large droplets of water will separate from the steam as a consequence of gravity and fall onto the top surface of baffle member 36. Due to the inclination of the baffle member, the water will flow downwardly along the top surface of the member and return via opening 38 to the first flow passage 34 where the droplets will be again exposed to the heat generated from heater 40.

The second steam flow passage 72 channels the steam flow in a counter-flow direction relative to the steam flowing through passage 34. The steam in the second passage is in heat transfer relation with the steam flowing in the first passage. The somewhat warmer temperature steam in the first flow passage transfers heat to the somewhat colder steam flowing through the second flow passage to maintain the temperature of the steam in the second passage at or near its original temperature level to thereby prevent the formation of excessive water condensation.

The steam flowing through second flow path 72 defined by the top surface of baffle member 36 and the lower surface of element 48 passes outwardly into wings 50 and then downwardly through openings 56 formed in member 44. The steam then enters channel 58 in first member 32 and passes outwardly from the member via slot 60 for distribution through the orifices 26 formed in the bottom surface of the soleplate. Slots 56 are generally aligned with heater 40. Any water droplets remaining in the steam transmitted through slots 56 should be vaporized as a result of direct contact with heater 40.

The thus described boiler 30 is effective in producing steam at or near saturation temperature. Due to the compact size of the boiler, the boiler does not significantly increase the elevational profile of the iron. The tortuous path established for the flow of steam through boiler 30 effectively separates any large droplets or slugs of water.

While a preferred embodiment of the present invention has been described and illustrated, the invention should not be limited thereto but may be otherwise embodied within the scope of the following claims.

What is claimed is:

1. An electric steam iron comprising:

a housing;

a water reservoir mounted in said housing;

means comprising a boiler mounted within said housing in fluid flow communication with said water reservoir;

a soleplate connected to said housing;

a first electrically operated heater mounted in said boiler;

a second electrically operated heater mounted in said soleplate;

fluid control means for regulating a flow of fluid from said water reservoir to said boiler;

a first thermostatic means for independently regulating an operating temperature of said boiler heater and second thermostatic means for independently regulating the operating temperature of said soleplate heater;

said boiler comprising a first member for receiving water from said reservoir and having said first heater mounted therewithin for transforming said water into steam, a second member overlying said first member and encompassing therebetween a first flow path for said steam generated in said first member, and a third member overlying said second member and encompassing therebetween a second flow path for said steam, said first and second flow paths being in fluid flow communication such that the steam flowing in said second flow path flows in a direction opposite to the steam flowing in said first flow path; and means for distributing the steam flowing from said second flow path through said soleplate.

2. The steam iron in accordance with claim 1 wherein the third member includes a pair of laterally extending wings in fluid flow communication with said second flow path and the second member includes at least one opening aligned with each wing.

3. The steam iron in accordance with claim 2 wherein said first member includes a channel aligned with the openings formed in said second member so that steam flowing through said second flow path is directed into said channel through said openings; and means for communicating the channel with said steam distributing means.

4. The steam iron in accordance with claim 1 wherein said second member includes an inclined baffle member for directing the steam exiting the first flow path upwardly along the second flow path.

5. The steam iron in accordance with claim 1 wherein the first member has a bottom wall sloped at substantially a 5 degree angle relative to the horizontal.

6. An electric steam iron comprising:

a housing a water reservoir mounted in said housing;

means comprising a boiler disposed in said housing in fluid flow communication with said water reservoir;

a soleplate attached to said housing;

a first electrically operated heater operatively connected to said boiler;

a second electrically operated heater operatively connected to said soleplate;

fluid control means for regulating a flow of fluid from said water reservoir into said boiler;

a first thermostatic means for independently regulating an operating temperature of said boiler heater and second thermostatic means for independently regulating an operating temperature of said soleplate heater;

said boiler comprising a first member in direct contact with said boiler heater and including a first portion for receiving water from said water reservoir and forming a boiler section for converting said water into steam, a second member spaced vertically above said first member for encompassing therebetween a longitudinally extending first flow path for said steam formed in said boiler section, a third member spaced vertically above said second member for encompassing therebetween a longitudinally extending second flow path, the end of said first flow path communicating with the beginning of said second flow path so that steam flowing through said second flow path is moving in an opposite direction to the steam flow through said first flow path, said third member including a pair of laterally extending wings to fluid flow communication with the end of said second flow path for defining lateral flow path extensions for the steam exiting the second flow path; and means in fluid flow communication with said wings and said soleplate for distributing steam from said wings through said soleplate.

7. The steam iron in accordance with claim 6 wherein said first member includes a channel in fluid flow communication with said wings, and means for communicating the channel with said steam distributing means.

8. The steam iron in accordance with claim 6 wherein said second member includes an inclined baffle member for directing the steam exiting the first flow path upwardly along the second flow path.

9. A boiler for generating steam in an electric steam iron having a water reservoir and a soleplate, said boiler comprising:

a first member for receiving water from said water reservoir and having an electrically operated heater for converting said water into steam;

passage means in said first member for directing the steam in a first axial direction;

a second member overlying said first member and including a first opening aligned with an end of said passage means and an axially extending inclined baffle member having a lower end aligned with said opening;

a third member overlying said second member for defining therebetween a second flow path for said steam, said second flow path being in communication with said first opening and being vertically above said passage means for directing steam flowing therethrough in an axial direction opposite to the direction of flow of steam through said passage means; and fluid distribution means communicating with said second flow path for distributing steam flowing through said flow path to said soleplate.

10. The boiler in accordance with claim 9 wherein the third member includes a pair of laterally extending wings in fluid flow communication with said second flow path and the second member includes at least one opening aligned with each wing.

11. The boiler in accordance with claim 10 wherein said first member includes a channel aligned with the openings formed in said second member through which steam flowing from said second flow path is directed into said channel.

12. The boiler in accordance with claim 9 wherein the first member has a bottom wall sloped at substantially a 5 degree angle relative to the horizontal.

* * * * *